United States Patent [19]

Kafka

[11] 4,226,374

[45] Oct. 7, 1980

[54] TWO LEVEL FEED TUBE FOR FOOD PROCESSOR

[75] Inventor: Barbara Kafka, New York, N. Y.

[73] Assignee: Cuisinarts, Inc., Greenwich, Conn.

[21] Appl. No.: 33,979

[22] Filed: Apr. 27, 1979

[51] Int. Cl.[3] ..... B02C 18/22

[52] U.S. Cl. ..... 241/37.5; 241/92; 241/282.1

[58] Field of Search ..... 241/37.5, 92, 199.12, 241/282.1, 282.2; 366/110; 81/3 R

[56] References Cited

U.S. PATENT DOCUMENTS

| | | | |
|---|---|---|---|
| 2,169,323 | 8/1939 | Martinet | 241/92 |
| 2,678,073 | 5/1954 | De Nardis | 241/282.2 X |
| 2,801,664 | 8/1957 | Rees | 241/37.5 |
| 3,892,365 | 7/1975 | Verdyn | 241/92 |
| 4,095,751 | 6/1978 | Artin | 241/37.5 |

*Primary Examiner*—Howard N. Goldberg

*Attorney, Agent, or Firm*—Parmelee, Johnson, Bollinger & Bramblett

[57] ABSTRACT

An integral two level feed tube is provided for a food processor having a working bowl for enclosing a rotary tool, and a removable cover adapted to be locked on the bowl with the two level feed tube forming a passageway through the cover into the bowl through which a food pusher can be plunged. The feed tube has an upper portion forming an upper passageway having a first (smaller) cross-sectional area and a lower portion forming a lower passgeway having a second (larger) cross-sectional area. The lower portion has a horizontally, inwardly projecting flange at its upper end where the smaller upper passageway enters the larger lower passageway. The pusher is plungable through both passageways for pushing food items toward the tool. The upper portion is substantially shorter than the lower portion. Accordingly, longer food items desired to be sliced lengthwise are inserted in the upper tube diagonally and come to rest horizontally ready for lengthwise slicing in the lower passageway. Also, the cover may be removed, inverted, and larger items placed directly into the larger lower passageway; or the item may be rested temporarily on the tool with the lower passageway enclosing the item when the cover is locked onto the bowl. The shape and size of the smaller upper passageway is configured to prevent an adult hand from extending through it for preventing inadvertent contact with an operating rotary tool.

4 Claims, 3 Drawing Figures

TWO LEVEL FEED TUBE FOR FOOD PROCESSOR

BACKGROUND OF THE INVENTION

This invention relates to a cover having a feed tube for a food processor and, more particularly, to a two level feed tube for such processors which provides a smaller food passageway in series with a larger food passageway in order to accommodate the processing of larger food items and/or to provide flexibility in the way such food items are processed, for example, slicing such items lengthwise.

Food processors of the type to which the present invention is applicable have a working bowl with a motor-driven shaft projecting upwards in the bowl on which various selected rotary food processing tools can be engaged to be driven by the shaft for performing various food processing operations in accordance with the desires of the user. A detachable cover is secured over the top of the bowl during use. The cover includes a feed tube having a mouth that opens downwardly through the cover into the top of the bowl. The food items to be processed are placed in this feed tube and are then manually pushed down through the feed tube into the bowl by means of a removable food pusher which is adapted to slide down in the manner of a plunger through the feed tube. Further information with respect to such food processors may be obtained by reference to U.S. Pat. No. 3,892,365—Verdun, 3,985,304—Sontheimer and 4,127,342—Marcel Coggiola.

The rotary tools used in food processors are driven by relatively powerful motor drive arrangements and have the capability of causing injury to a finger or hand if the user inadvertently bring a hand into contact with the motor-driven tool. For this reason, a bowl cover safety feature is conventionally incorporated into these units. This feature requires that the cover be firmly locked onto the bowl in normal operating position before the motor will start. This requirement is achieved by making the cover, which locks rotationally to the bowl, with a projection or member which causes the closing of a switch carried by a housing only when the cover is properly locked in its normal operating position on the bowl. Depending upon the type of food processor the aforesaid projection may actuate the switch directly or through an intermediate linkage. Thus, the motor cannot be energized before the cover is properly positioned on the bowl. However, this requirement that the cover be locked in place would not prevent injury if a hand were inserted down through the feed tube. Accordingly, the feed tube in accordance with another safety feature is deliberately designed in terms of shape, cross-section and height, i.e. it is relatively tall and narrow, to make it impossible for an adult inadvertently to insert a hand sufficiently far down into the feed tube to touch a rotating tool located in the upper portion of the working bowl. In addition, a food pusher is provided insertable into the feed tube for feeding food items down into engagement with the food processing tool.

The above limitations imposed on the size and shape of the feed tube for safety considerations limits the size and shape of food items which can be inserted and food processing operations which can be performed on such food items. For example, lengthwise slicing of carrots, cucumbers, celery, etc. could of necessity be severely limited to the crosswise dimension of the narrow prior art feed tube.

SUMMARY

It is an object of the present invention to provide a new and novel feed tube for a food processor which accommodates the processing of larger food items without substantially altering the food processor or the safety features which are currently incorporated therein.

Another object of the invention is to provide a new and novel feed tube for a food processor which is simple in construction and can be used on conventional commercially available food processors simply by altering the construction of the cover without making other modifications to the food processor.

Still another object of this invention is to provide a new and novel two level feed tube which expands the use of the food processor without compromising the safety aspects of conventional feed tubes.

In carrying out this invention in one illustrative embodiment thereof, an integral two level feed tube is provided which is mounted on the cover of the food processor having an upper tube portion forming an upper passageway therethrough of a first smaller cross-sectional area and a lower tube portion forming a lower passageway having a second larger cross-sectional area. The upper tube portion is mounted on an upper inwardly extending flange of the lower tube portion thereby providing a smaller food passageway through the upper tube portion in series with a larger food passageway in the lower tube portion. A food pusher is plungable through both the upper and lower passageways for pushing food items toward the rotary food processing tool mounted in the working bowl of the food processor. This construction provides an expanded use for the food processor since the lower food passageway is larger and can accommodate larger food items, either in total overall size or in lengthwise dimension. A large volume food item which is not insertable through the upper tube portion can be inserted directly into the lower tube portion by temporarily removing the cover and inverting it and placing the large food item into the large lower tube portion like into a socket, or alternatively by temporarily resting the food item on the rotary disc-like tool with the lower food passageway then enclosing this item as the cover is being locked onto the bowl. This permits not only the processing of larger food items but also the cutting of elongated items lengthwise when they lie horizontally in the lower larger tube portion.

BRIEF DESCRIPTION OF THE DRAWINGS

The invention, together with further objects and advantages thereof, will be better understood from the following description taken in connection with the accompanying drawings.

DESCRIPTION OF THE PREFERRED EMBODIMENT

Figure 3:
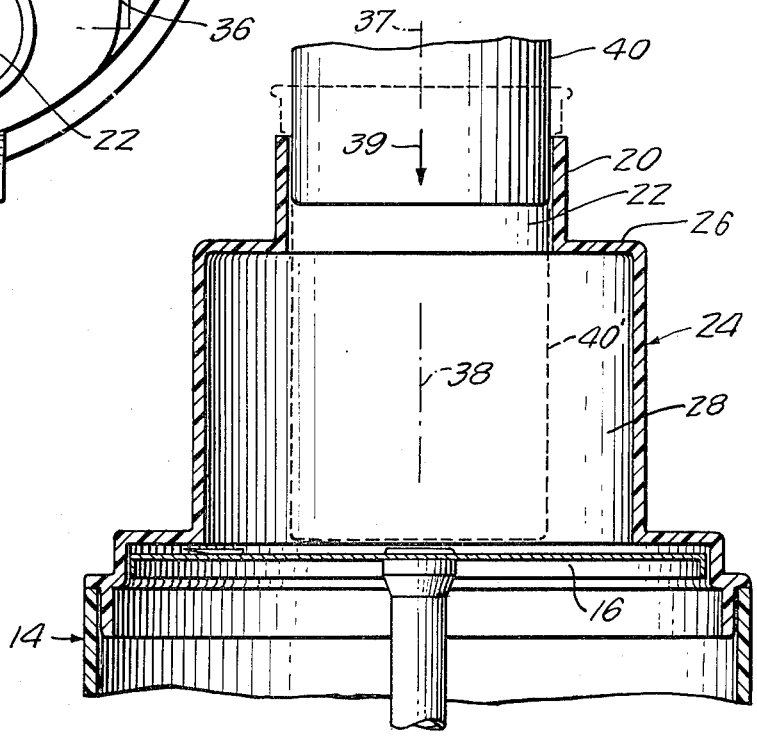
FIG. 3 is a cross-sectional view taken along lines 3—3 of FIG. 2.

Referring now to the drawings, a feed tube, generally referred to with the reference character 10, is integrally mounted on a cover 12 having a locking means 18 thereon which can be removably secured to a working bowl 14. The working bowl 14 encloses a rotary food processing tool 16, as shown in FIG. 3, adapted to rotate within the bowl 14. The top of the bowl 14 is closed by the cover 12 which is arranged to be engaged in a locked relationship by the locking means 18 on the cover cooperating with complementary locking means (not shown) on the bowl 14.

The cover 14 may be held in locked engagement with the bowl 14 by placing the cover on the rim of the bowl and turning the cover to obtain a twist-lock effect. The food processor is arranged so that it will not operate unless the cover is properly locked on the bowl. There is a control switch which is actuated once the cover is locked in proper position in order to enable operation of the food processor. It will be understood that there are numerous ways and means in which such a cover 12 may be held in locking engagement upon the working bowl 14 during the operation of the food processor.

It will be further understood that a variety of different types of food processing tools, one of which is illustrated in 16, may be provided to be selectively mounted for rotation within the bowl 14. Reference may be had to the aforesaid patents for various details of the mounting of the rotary tool in the working bowl, in the attachment of the cover to the bowl, as well as further details with respect to the type of food processor in which the present invention may be employed. Since such details do not form a part of this invention, a full description is not provided herein.

The integral, two level feed tube 10, in accordance with the present invention, extends upwardly from the cover 12. The feed tube comprises an upper tube portion 20 and a lower tube portion 24. The upper tube portion 20 has a passageway 22 therethrough which is adapted to receive a food pusher 40 therein which may be plunged through the passageway 22 with only a small clearance between the barrel of the food pusher 40 and the inner surface of the upper tube portion 20. The upper feed tube portion 20, and the passageway 22 defined therein, are of conventional size and oval shape for restricting the inadvertent insertion of an adult hand therethrough.

The lower tube portion 24 has a horizontal inwardly extending flange 26 on the upper end thereof on which the upper tube portion 20 is mounted. The lower tube portion 24 defines a second food passageway 28 therein which is best seen in FIG. 3.

Figure 2:
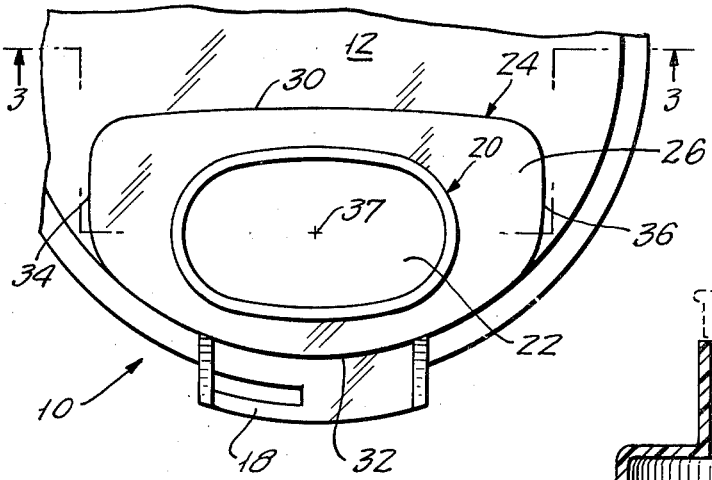
FIG. 2 is a partial top view of the cover, showing the new and novel feed tube of FIG. 1.

As will be seen in FIG. 2, the large cross-section lower portion 24 of the feed tube 10 has a generally rounded rectangular configuration, as defined by two generally flat, parallel sidewalls 34 and 36 connecting a wide, gently arced inner wall 30 and an arcuate peripheral outer wall 32 conforming generally to the circular shape of the top of the cover 12.

Figure 1:
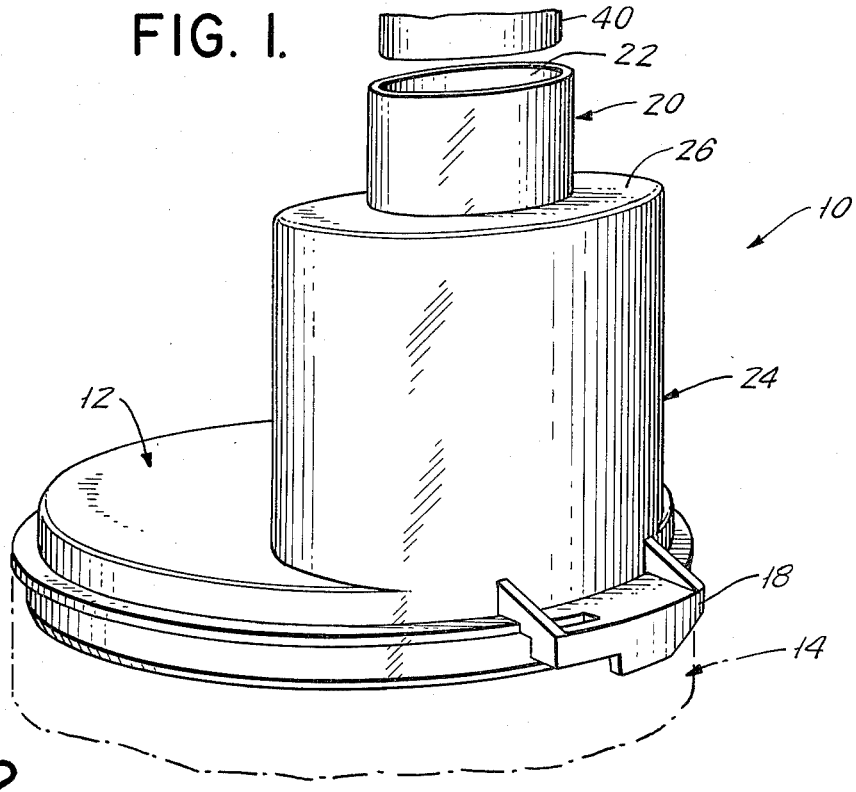
FIG. 1 is a perspective view of the new and novel two level feed tube in accordance with the present invention showing the lower end of a food pusher ready to be inserted therein.

As will be apparent from FIGS. 1–3, the oval shape and cross-sectional area of the upper tube portion 20 forming the first food passageway 22 therethrough is dramatically contrasted to the rectangular arcuate shape of the lower tube portion 24 and its second food passageway 28 therein which has a substantially larger cross-sectional area.

What has thus been provided is a smaller food passageway 22 in series with a larger food passageway 28. As seen in FIG. 3 the axis 37 of the upper food passageway 22 is directly aligned with the axis 38 of the lower larger food passageway 28. As shown in FIG. 3 by the arrow 39 and by the dashed outline 40', the food pusher 40 is plungable through the upper and lower passageways 22 and 28, respectively for pushing food items toward the rotary processing tool 16, which is here shown as a tool having a disc-like configuration and being located near the top of the working bowl 14.

The feed tube 10, in accordance with the present invention, has a substantially shorter upper portion 20 than the lower portion 24. Several dramatic advantages are achieved by the feed tube 10. By providing the conventional oval shape for upper portion 20, the safety feature of the size and shape of the upper portion 20 of the feed tube 10 prevents the adult hand from inadvertently being inserted through the feed tube. The larger dimension of the second food passageway 28 permits the accommodation of larger food items than can normally be accommodated in the conventional oval-shape feed tube.

Elongated food items may be inserted diagonally through the food passageway 22 and may come to rest in a lengthwise-horizontal position in the larger food tube passageway 28 thereby permitting lengthwise slicing or processing of the food item when the tool 16 is a slicing disc. Larger volume or bulkier food items which do not fit through the passageway 22 may be inserted directly into the larger food passageway 28 by temporarily removing the cover 12 and inverting it and inserting the items and slightly lodging them directly into the passageway 28 like being inserted into a socket. The cover may then be placed back in locked position on the bowl, the machine turned on, and the food pusher 40 used to dislodge the larger items to move them down from the food passageway 28 into contact with the rotary processing tool 16 in the working bowl 14.

Alternatively, larger food items may be placed directly on the disc-like rotary processing tool 16, the cover placed over such items with the items being received in lower food passageway 28, the cover then being locked on the bowl and the machine operated thereby processing such larger food items, which otherwise could not be inserted through a conventional feed tube.

The dramatic results achieved by this invention are available simply by providing the cover 12 with this novel feed tube without altering the rest of the food processor. The feed tube 10, in accordance with the present invention, may be molded as an integral part of the cover 12 without altering or modifying the rest of the food processor. The cover, so modified by providing the feed tube in accordance with the present invention, extends the versatility, flexibility, and expands the uses of the food processor.

Since other modifications and changes vary to fit particular operating requirements and environments will be apparent to those skilled in the art, the invention is not considered limited to the example chosen for purposes of illustration and covers all modifications and changes which do not constitute a departure from the true spirit and scope of this invention as defined in the following claims.

What is claimed is:

1. For use in the cover for a food processor of the type having a working bowl for enclosing a rotary food processing tool which is adapted to rotate within said bowl, said cover being removable and being adapted to be locked on said bowl and having a feed tube mounted thereon forming a passageway for feeding food items through said cover into said bowl, and in which a food pusher can be plunged into said passageway for pushing food items toward the rotary food processing tool, a novel feed tube comprising:

an integral two level feed tube mounted on said cover having a lower tube portion forming a lower passageway with a first cross-sectional area, an inwardly extending flange at the top of said lower tube portion, an upper tube portion mounted on said flange, said upper tube portion forming an upper passageway therethrough having a second cross-sectional area which is less than the cross-sectional area of said lower passageway and which communicates down into said lower passageway, thereby providing a smaller upper food passageway in series with a larger lower food passageway, said food pusher being plungable through said upper and lower passageways for pushing food items toward the rotary food processing tool.

2. The food tube set forth in claim 1 wherein said upper tube portion is substantially shorter than said lower tube portion.

3. The feed tube set forth in claim 1 or 2 in which said lower tube portion has a different shape than said upper tube portion.

4. The feed tube set forth in claims 1 or 2 in which said lower tube portion has a generally rounded rectangular-arcuate configuration, and said upper tube portion has an oval shape of a size to prevent the inadvertent insertion of an adult hand completely therethrough.

* * * * *